US010770056B1

(12) United States Patent
Zafeiropoulos

(10) Patent No.: US 10,770,056 B1
(45) Date of Patent: Sep. 8, 2020

(54) SELECTIVE NOISE CANCELLATION FOR A VEHICLE

(71) Applicant: Harman Becker Automotive Systems GmbH, Karlsbad (DE)

(72) Inventor: Nikos Zafeiropoulos, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 16/508,828

(22) Filed: Jul. 11, 2019

(51) Int. Cl.
*G10K 11/178* (2006.01)
*G10K 11/175* (2006.01)
*F01N 1/06* (2006.01)

(52) U.S. Cl.
CPC ..... *G10K 11/175* (2013.01); *F01N 1/065* (2013.01); *G10K 2210/1282* (2013.01); *G10K 2210/3226* (2013.01)

(58) Field of Classification Search
CPC ..... G10K 11/175; G10K 2210/1282; G10K 11/178
USPC ..... 381/71.1, 71.4, 71.11
See application file for complete search history.

(56) References Cited

U.S. PATENT DOCUMENTS 10,056,066 B2 8/2018 Christoph et al.
2010/0124337 A1* 5/2010 Wertz ..... G10K 11/178 381/71.11
2010/0290635 A1* 11/2010 Shridhar ..... G10K 11/178 381/71.1

* cited by examiner

*Primary Examiner* — Vivian C Chin
*Assistant Examiner* — Ubachukwu A Odunukwe
(74) *Attorney, Agent, or Firm* — Brooks Kushman P.C.

(57) ABSTRACT

In at least one embodiment, a computer-program product embodied in a non-transitory computer readable medium that is programmed to perform selective active noise cancellation (ANC) for a vehicle is provided. The computer-program product comprising instructions to determine an amount of noise present in a first zone and a second zone and to selectively drive only at least one first loudspeaker in the first zone to generate a first cancellation field to cancel road noise and/or engine noise if the amount of noise in the first zone is greater than the amount of noise in the second zone. The computer-program product comprising instructions to selectively drive only at least one second loudspeaker in the second zone to generate the second cancellation field to cancel road noise and/or engine noise if the amount of noise in the second zone is greater than the amount of noise in the first zone.

18 Claims, 9 Drawing Sheets

SELECTIVE NOISE CANCELLATION FOR A VEHICLE

TECHNICAL FIELD

Aspects disclosed herein generally relate to an apparatus and method for performing selective noise cancellation for a vehicle. These aspects and others will be discussed in more detail herein.

BACKGROUND

U.S. Pat. No. 10,056,066 to Christoph et al. provides a noise reducing sound reproduction system that includes a loudspeaker that is connected to a loudspeaker input path and that radiates noise reducing sound. A microphone is connected to a microphone output path and picks up the noise or a residual thereof. An active noise reduction filter is connected between the microphone output path and the loudspeaker input path, and the active noise reduction filter comprises at least one shelving filter.

SUMMARY

In at least one embodiment, a system for performing selective active noise cancellation (ANC) for a vehicle is provided. The system includes a plurality of reference sensors for being positioned external to a vehicle cabin and being configured to generate reference signals indicative of at least one of road noise and engine noise that is external to the vehicle cabin. The system further includes at least one first loudspeaker for being positioned in a first zone of the vehicle and being configured to generate a first cancellation field to cancel the at least one of road noise and engine noise in the first zone. The system further includes at least one second loudspeaker for being positioned in a second zone of the vehicle and being configured to generate a second cancellation field to cancel the at least one of road noise and engine noise in the second zone. The system further includes a plurality of error microphones for being positioned in the first zone and the second zone of the vehicle and being configured to generate a plurality of error signals. The system further includes at least one ANC controller configured to determine an amount of noise present in the first zone and the second zone; and to selectively drive only one of the at least one first loudspeaker in the first zone to generate the first cancellation field or only the at least one second loudspeaker in the second zone to generate the second cancellation field based on the reference signals, the plurality of error signals and further based on the amount of noise present in the first zone and the second zone.

In at least another embodiment, a method for performing selective active noise cancellation (ANC) for a vehicle is provided. The method includes generating reference signals via a plurality of reference sensors positioned external to a vehicle cabin, the reference signals being indicative of at least one of road noise and engine noise that is external to the vehicle cabin and generating a first cancellation field via at least one first loudspeaker that is positioned in a first zone of the vehicle. The first cancellation field cancelling the at least one of road noise and engine noise in the first zone. The method further includes generating a second cancellation field via at least one second loudspeaker that is positioned in a second zone of the vehicle. The second cancellation field cancelling the at least one of road noise and engine noise in the second zone. The method further includes generating a plurality of error signals via a plurality of error microphones that is positioned in the first zone and the second zone of the vehicle and determining an amount of noise present in the first zone and the second zone. The method further includes selectively driving only one of the at least one first loudspeaker in the first zone to generate the first cancellation field or only the at least one second loudspeaker in the second zone to generate the second cancellation field based on the reference signals, the plurality of error signals and further based on the amount of noise present in the first zone and the second zone.

In at least another embodiment, a computer-program product embodied in a non-transitory computer readable medium that is programmed to perform selective active noise cancellation (ANC) for a vehicle is provided. The computer-program product comprising instructions to determine an amount of noise present in a first zone and a second zone of the vehicle and to selectively drive only at least one first loudspeaker in the first zone to generate a first cancellation field to cancel at least one of road noise and engine noise in the first zone if the amount of noise in the first zone is greater than the amount of noise in the second zone. The computer-program product comprising instructions to selectively drive only at least one second loudspeaker in the second zone to generate the second cancellation field to cancel the at least one of road noise and engine noise in the second zone if the amount of noise in the second zone is greater than the amount of noise in the first zone.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It is recognized that the controllers as disclosed herein may include various microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof), and software which co-act with one another to perform operation(s) disclosed herein. In addition, such controllers as disclosed utilizes one or more microprocessors to execute a computer-program that is embodied in a non-transitory computer readable medium that is programmed to perform any number of the functions as disclosed. Further, the controller(s) as provided herein includes a housing and the various number of microprocessors, integrated circuits, and memory devices ((e.g., FLASH, random access memory (RAM), read only memory (ROM), electrically programmable read only memory (EPROM), electrically erasable programmable read only memory (EEPROM)) positioned within the housing. The controller(s) as disclosed also include hardware-based inputs and outputs for receiving and transmitting data, respectively from and to other hardware-based devices as discussed herein.

Figure 1:
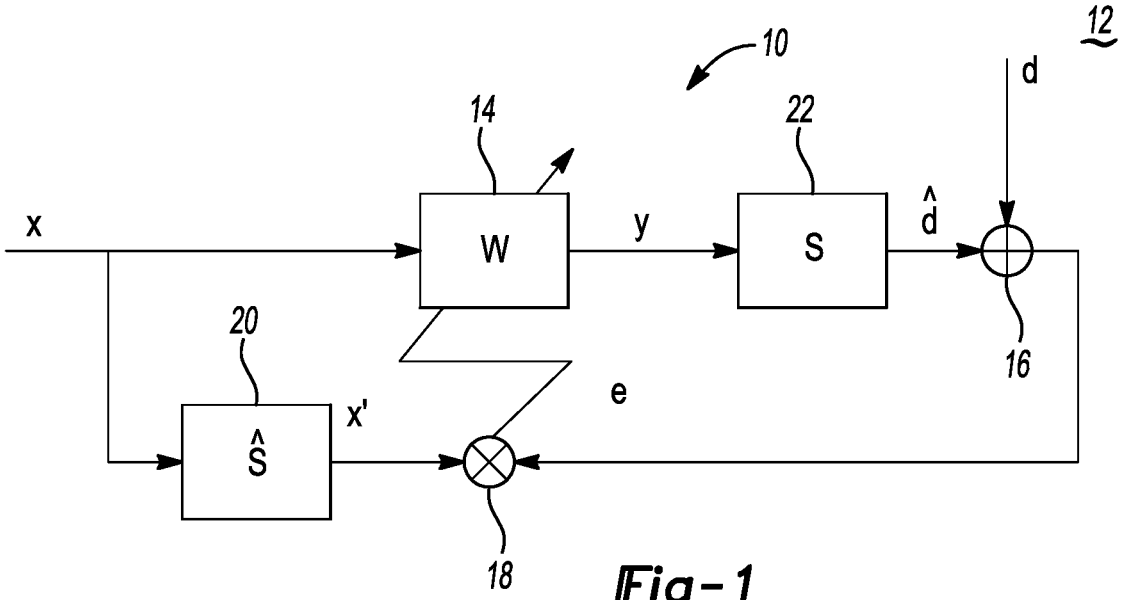
FIG. 1 depicts an example of an apparatus that performs active noise cancellation in a vehicle.

FIG. 1 depicts an example of an apparatus 10 that performs active noise cancellation in a vehicle 12. The apparatus 10 may be implemented in an active noise cancellation (ANC) controller (not shown) or other suitable device that includes any number of processors (e.g., digital signal processers (DSPs), etc.). The apparatus 10 may be part of a multichannel ANC system that utilizes a large secondary path matrix. In this case, the apparatus 10 may utilize a large secondary path that can drain computational resources from the DSP. Aspects provided herein generally provide for a selective ANC system that performs ANC calculations based on desired zones in the vehicle 12. For example, ANC may be performed in zones of the vehicle based on priority (e.g., the zone in the vehicle that is the loudest) to reduce computational processing of algorithms that are used in connection with performing ANC. An ANC system generally utilizes a plurality of microphones (not shown) positioned about a vehicle cabin and a plurality of loudspeakers (not shown) also positioned in zones of the vehicle 12. In one example, a front zone of the vehicle 12 (e.g., where a driver and a front passenger positioned proximate to the driver between A and B pillars of the vehicle 12) may include any number of loudspeakers positioned therein. In addition, a rear zone of the vehicle (e.g., where rear seat passengers proximate to one another between the B pillar and a C pillar of the vehicle 12) may include any number of loudspeakers (not shown) positioned therein.

The apparatus 10 (or ANC controller) is generally configured to receive reference signals from reference sensors such as noise and vibration sensors that may include acceleration sensors such as accelerometers, force gauges, load cells, etc. For example, an accelerometer is a device that measures proper acceleration. The reference signals may represent noise (e.g., road noise (i.e., vibrational noise due to road dynamics) or engine noise) that may be heard by vehicle passengers in the front and rear zones of the vehicle 12. The ANC controller 10 generally performs road noise cancellation (RNC) and engine order cancellation (EOC) and the foregoing sensors are generally utilized for RNC and EOC. The ANC controller 10 is configured to generate a compensation signal that includes a phase opposite to that of the noise on the reference signal. The ANC controller 10 drives the loudspeakers in the front zone and the rear zone with the compensation signals to cancel or eliminate the noise in each of the front or rear zones that may correspond to engine or road noise. Residual noise (or other disturbing noise) may still be present in the front or the rear zones of the vehicle 12. A resulting microphone generates a signal indicative of such noise as an error signal and the ANC controller 10 adapts filter coefficients to generate an additional compensation signal that minimizes the noise heard by the listener in the vehicle 12.

Figure 2:
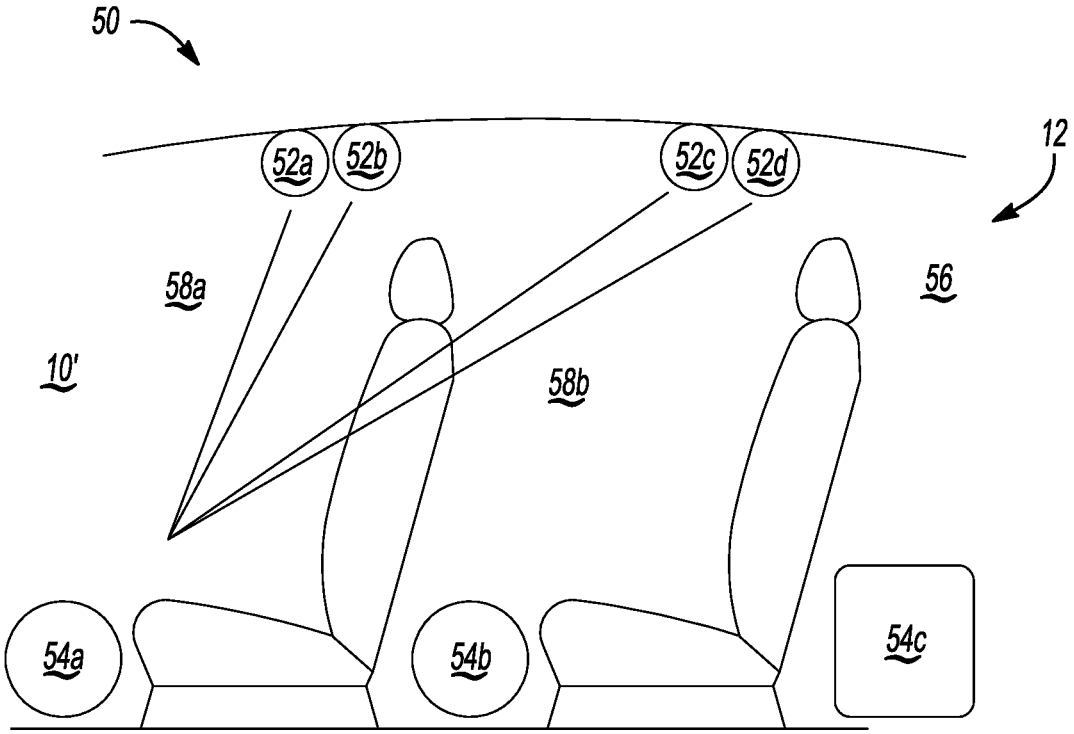
FIG. 2 depicts one example of a system that performs selective noise cancellation in a vehicle in accordance to one embodiment.

The above aspect will be described in more detail. For example, the ANC controller 10 generally includes a first adaptive filter (e.g., a W-filter) 14, a multiplier circuit 18, and a second filter 20. A residual microphone 16 (or error microphone 16) (i.e., any one of elements 52*a*-52*d* as illustrated in FIG. 2) is also shown and provided to interface with the ANC controller 10. In one example, the residual microphone 16 is generally positioned in a headliner or other area in the vehicle 12. It is recognized that the number of first adaptive filters 14, the residual microphones 16, multiplier circuits 18, and second filter 20 may vary based on the desired criteria of a particular implementation. In the example noted directly above, the first adaptive filter 14 receives reference signals (e.g., x) from noise and vibration sensor such as, for example, accelerometers. The reference signals correspond to engine and/or road noise. The first adaptive filter 14 adjusts its filter coefficients and generates a driving signal, y to drive the various loudspeakers in the vehicle 12 to cancel the road noise or vibrational noise that may be present in the vehicle 12. The loudspeakers (not shown) generate a cancellation signal, d' which propagates through a secondary path 22. The residual microphone 16 receives the cancellation signal, d' and a residual noise signal, d that corresponds to residual or actual noise that is present in the front and rear zones of the vehicle 12. The residual microphone 16 generates an error signal that corresponds to the difference between the cancellation signal and the residual noise signal. The second filter 20 also receives the reference signals, x and generates filtered reference signals, x'. The multiplier circuit 18 takes the product of the filtered reference signals, x' and the error signal and outputs the product to the first adaptive filter 14. The first adaptive filter 14 updates its coefficients to generate another driving signal, y to drive the loudspeakers to generate another cancellation field to cancel not only road or engine noise, but the actual noise that is present in the front and the rear zones of the vehicle 12.

The ANC controller 10 may utilize any number of filter matrices for each first adaptive filter 14 with an M×K size, where M corresponds to the loudspeakers in the vehicle 12 and K corresponds to the number of reference signals. In one example, there may be a total of 13 reference signals in which one reference signal is utilized for EOC and the remaining twelve reference signals are utilized in connection with RNC. The second filter 20 may be implemented as a Least Mean Squares (LMS) filter or other suitable variant thereof and have a size of L×M, where L corresponds to the number of error signals and M corresponds to the number of loudspeakers.

In some cases, the ANC controller 10 may not be able to train all of the first adaptive filters 14 at the same time if more than five loudspeakers and four microphones are present in the secondary path 22. Therefore, a partial update of the filter matrix for the first adaptive filter 14 may be needed that also results in a partial computation of a convolution matrix W*x that generates the driving signal for the loudspeakers to provide the cancellation signal. Any increase in the number of reference sensors (e.g., accelerometer, etc.), loudspeakers, and microphones may result in a significant increase in machine instructions per second (MIPS) for the first adaptive filter 14. Each filter matrix of the first adaptive filter 14 may be updated, for example, per the following:

12×Fast Fourier Transforms (FFTs) for the reference signals+4×FFTs for the error signals=16×FFTs, and/or 12×5×4 references×secondary path matrix multiplication=240×Multiplications for the filtered reference signals.

As for the cancellation signals, the following convolutions with the first adaptive filter 14 at a high sampling rate may be performed, for example, with the following:

12×5 Finite Impulse Response (FIR) time domain convolutions.

A frequency domain—Filtered Least mean squared (Fx-LMS) update equation is set forth below that updates a full W-matrix for the first adaptive filter 14:

$$w_{MK}(n+N) = w_{MK}(n) + \mu IFFT\{\sum_{l=1}^{L} S_{LMK}(f)E_L(f)\} \quad \text{(Eq. 1)}$$

A full W-matrix update is generally performed according to an R-filtered reference matrix that is also a main MIPS consuming part of the updated equation. The R matrix generally includes three dimensions such as L (e.g, the number of microphones, M (e.g., the number of loudspeakers), and K (e.g., the number of reference signals (or reference sensors)) The R-matrix may constrain all the multiplications between all S-secondary path filters and the all the reference signals that are provided from the reference sensors (e.g., accelerometers sensors in an engine compartment and/or front/rear axle). It is recognized that selective noise cancellation can be performed between the front and rear zones of the vehicle 12. As noted above, performing a full active noise cancellation for the entire vehicle 12 may be too computationally expensive. However, by selectively performing active noise cancellation between zones of the vehicle 12, processing overhead may be significantly reduced while still maintaining proper levels of performance. These aspects will be discussed further below.

FIG. 2 depicts one example of a system 50 that performs selective noise cancellation in the vehicle 12 in accordance to one embodiment. The system 50 generally includes the ANC controller 10', a plurality of error microphones (including the residual microphone 16) 52*a*-52*d*, and a plurality of loudspeakers 54*a*-54*c* positioned within a listening area 56 of the vehicle 12. The vehicle 12 may be separated into any number of zones (e.g., front, rear, middle, etc,). For example, the vehicle 12 may include a front zone 58*a* and a rear zone 58*b*. As noted above, the front zone 58*a* of the vehicle 12 may correspond to the location in the vehicle 12 where a driver and a front passenger are positioned proximate to one another (e.g., driver and passenger are located in front row seating that is positioned between A and B pillars of the vehicle 12). The rear zone 58*b* of the vehicle 12 corresponds to the location in the vehicle 12 where rear seat passengers are proximate (e.g., passengers are located in passenger row only seating that is positioned between the B pillar and a C pillar of the vehicle 12). Microphones 52*a*, 52*b* and loudspeaker 58*a* may generally be positioned in the front zone 58*a*. Microphones 52*c*, 52*b* and loudspeakers 54*b*, 54*c* may generally be positioned in the rear zone 58*b*. The system 50 as illustrated in FIG. 2 is generally configured to perform active noise cancellation in connection with the front zone 58*a*. As illustrated, the loudspeaker 54*a* provides a cancellation signal in the front zone 58*a* to remove road/engine and other undesirable noise in the front zone 58*a*. This will be discussed in more detail below.

Figure 3:
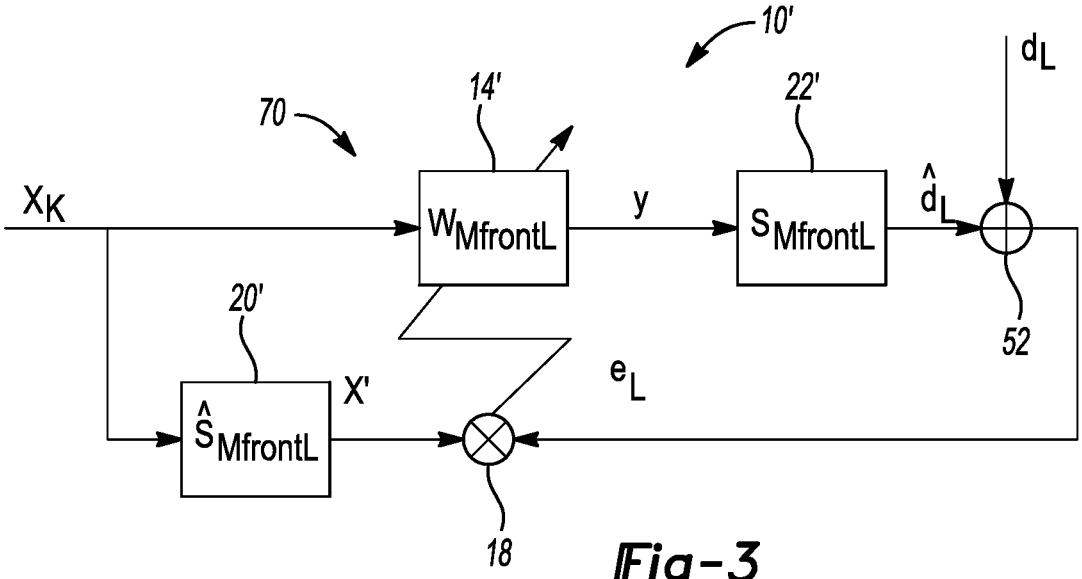
FIG. 3 depicts an apparatus that is used in connection with the system of FIG. 2 to perform the selective noise cancellation in accordance to one embodiment.

FIG. 3 generally depicts the ANC controller 10' that is configured to perform selective noise cancellation for the front zone 58*a* of the vehicle 12. For example, the ANC controller 10' includes a first front adaptive filter 14', the multiplier circuit 18, any one of the microphones 52*a*-52*d* (or 52), and the second front filter 20'. A front secondary path 22' is also shown to correspond to a secondary path between the loudspeaker 54*a* and the microphones 52.

The first front adaptive filter 14' adjusts its filter coefficients and generates a driving signal, y to drive the loudspeaker 54*a* in the front zone 58*a* to cancel the road noise, engine noise, or vibrational noise based on the information included in the reference signal $x_k$. The loudspeaker 54*a* generates a cancellation signal, $d'_L$ which propagates through the front secondary path 22'. The residual microphone 52 receives the cancellation signal, $d'_L$ and a residual noise signal, $d_L$ that corresponds to residual or actual noise that is present in the front zone 58*a* of the vehicle 12. The residual microphone 52 generates an error signal $e_L$ that corresponds to the difference between the cancellation signal and the residual noise signal $d_L$. The second front filter 20' also receives the reference signals, $x_K$ and generates filtered reference signals, x'. The multiplier circuit 18 takes the product of the filtered reference signals, x' and the error signal and outputs the same to the first front adaptive filter 14. The first front adaptive filter 14' updates its coefficients to generate another driving signal, to drive the loudspeaker 54*a* in order to generate another cancellation field to cancel not only road and/or engine noise, but the actual noise that is present in the front zone 58*a* of the vehicle 12.

The first front adaptive filter 14' can be adapted separately to not only cancel road noise but cancel other noise present in the front zone 58 according to the following equation:

$$w_{M_{front}K}(n+N) = w_{M_{front}K}(n) + IFFT\{\mu(f)\sum_{l=1}^{L} S_{LM_{front}K}(f)E_L(f)\} \quad \text{(Eq. 2)}$$

It is recognized that the ANC controller 10' may receive inputs from all of the microphones 52*a*-52*d* in the vehicle 12 irrespective of whether the microphones 52*a*-52*d* are positioned in the front zone 58*a* or the rear zone 58*b* in order to update the filter matrix for the first adaptive filter 14' and to prevent waterbed effects (e.g., undesired sound pressure) from being present in the sound field of the front zone 58*a* and the rear zone 58*b*. In general, the microphones 52*a*-52*d* may be considered to define a cost function that the FxLMS algorithm is reducing. Therefore, if an output signal from any one of the microphones 52*a*-52*d* is not used or neglected, then the sound pressure at that corresponding location (i.e., where the microphone is not used) may increase while the sound pressure at the other locations where the microphones 52*a*-52*d* are present and considered is greatly reduced. In view of the foregoing, all the of microphones 52*a*-52*d* should be used also for the partial update of the FxLMS algorithm for the first adaptive filter 14 when the ANC controller 10' selectively performs noise cancellation for the front zone 58*a* and for the rear zone 58*b*.

Figure 4:
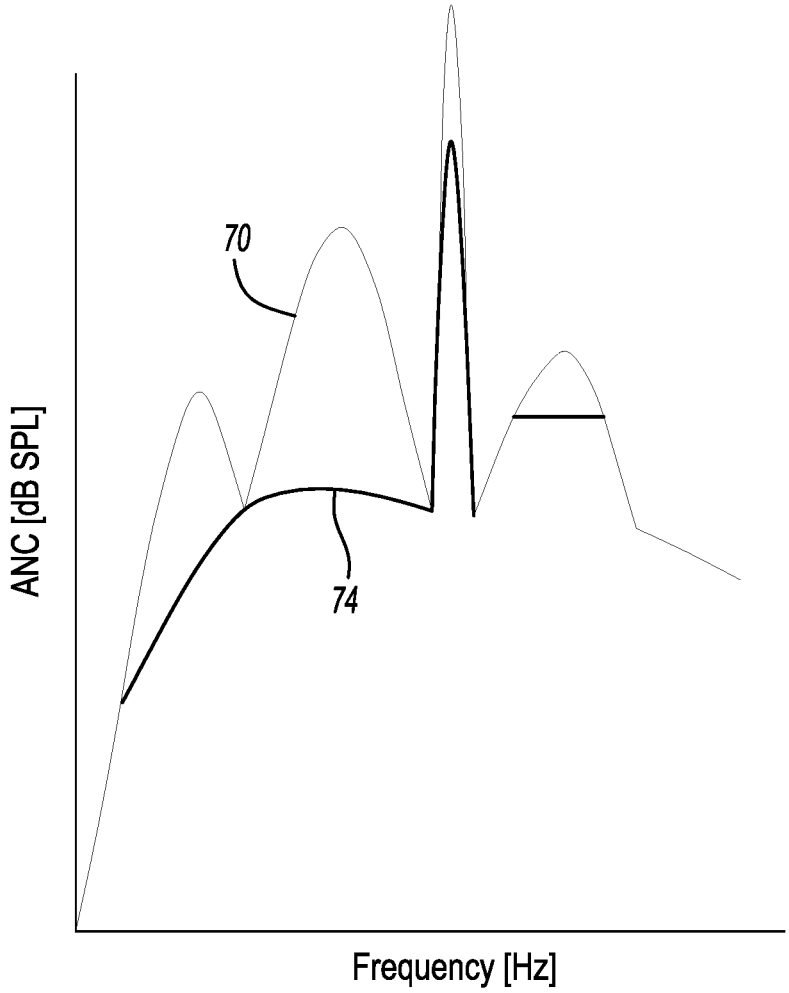
FIG. 4 depicts a plot corresponding to sound pressure level and frequency for the system of FIG. 2 in accordance to one embodiment.

FIG. 4 generally depicts training for the FxLMS algorithm for only the loudspeaker 54*a* in the front zone 58*a* with respect to the ANC performance. In general, waveform 70 corresponds to the sound pressure and frequency in the front zone 58*a* when active noise cancellation is performed therein. Waveform 74 generally corresponds to the sound pressure and frequency in the front zone 58*a* when active noise cancellation is disabled.

Figure 5:
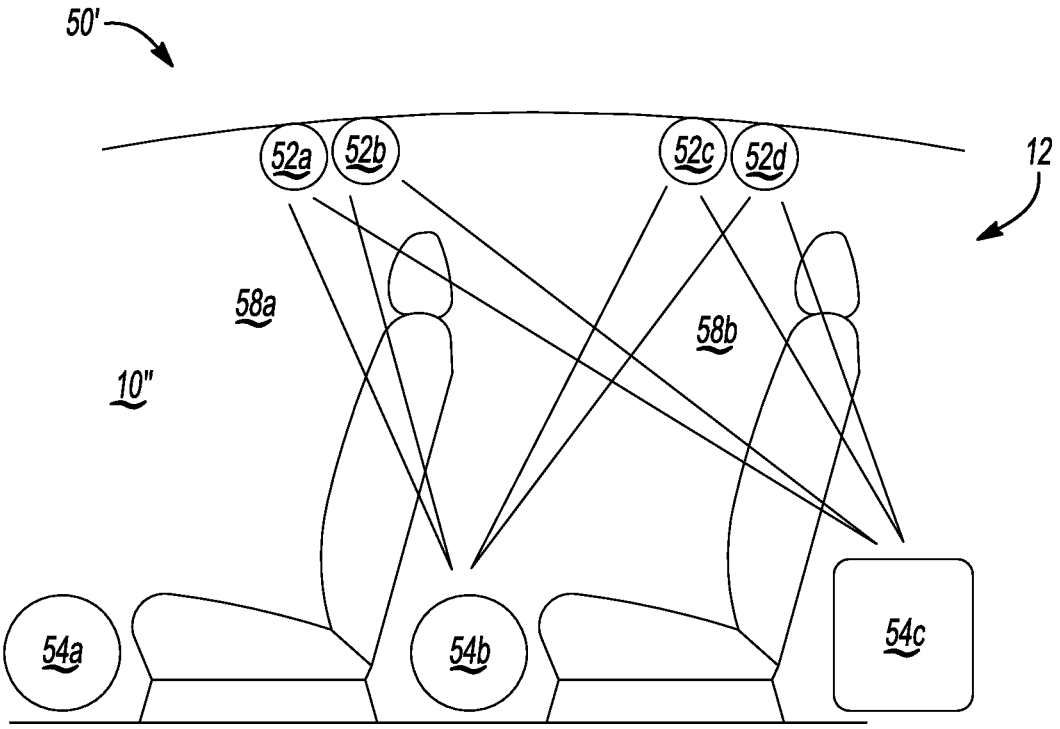
FIG. 5 depicts another example of a system that performs selective noise cancellation in the vehicle in accordance to one embodiment.

FIG. 5 generally illustrates a system 50' that is configured to perform active noise cancellation in the rear zone 58*b*. As shown, the loudspeaker 54*b*, 54*c* positioned in the rear zone 58*b* are each configured to provide a cancellation signal in the rear zone 58*b* to remove road/engine noise and/or other disturbing noise that is present in the rear zone 58*b*. This aspect will be discussed in more detail below.

Figure 6:
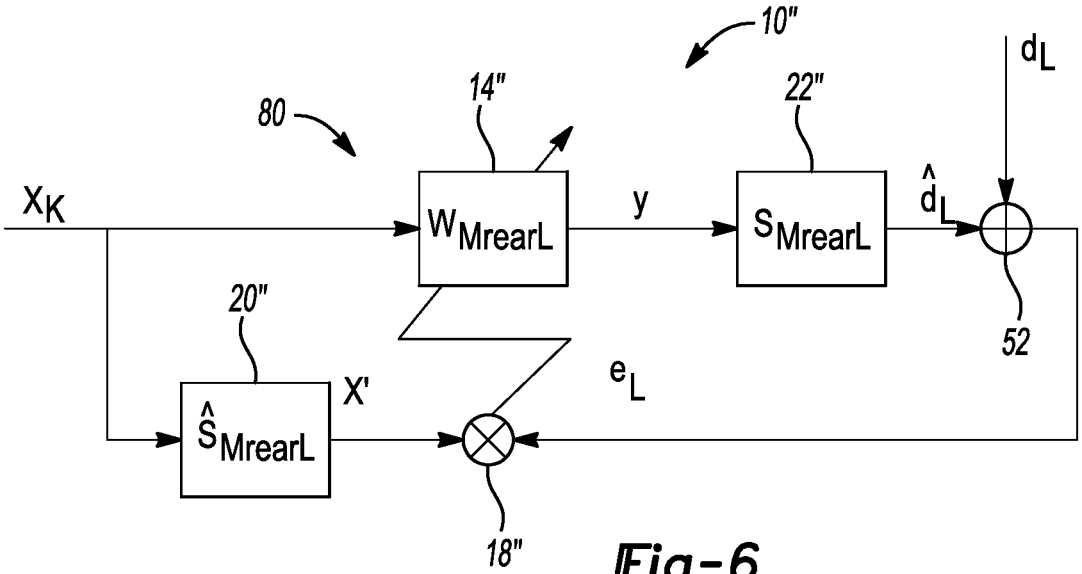
FIG. 6 depicts an apparatus that is used in connection with the system of FIG. 5 to perform the selective noise cancellation in accordance to one embodiment.

FIG. 6 generally depicts an ANC controller 10" that is configured to perform selective noise cancellation for the rear zone 58*b* of the vehicle 12. For example, the ANC controller 10" includes a first rear adaptive filter 14", the multiplier circuit 18, any one of the microphones 52*a*-52*d* (or 52), and the second rear filter 20". A rear secondary path 22' is also shown to correspond to a secondary path between the loudspeakers 54*b*, 54*c* and the microphones 52.

The first rear adaptive filter 14" adjusts its filter coefficients and generates a driving signal, y to drive the loudspeaker 54*b* or the loudspeaker 54*c* in the rear zone 58*b* to cancel the road or engine noise based on the information included in the references signal $x_k$. It is recognized that a dedicated rear adaptive filter 14" is provided for each loudspeaker 54*b*, and 54*c* (i.e., a dedicated front adaptive filter 14' may also be provided for each loudspeaker 54*a* positioned in the front zone 58*a*). Each of the loudspeakers 54*b*, 54*c* generates a cancellation signal, d which propagates through the rear secondary path 22". The residual microphone 52 receives the cancellation signals, $d_L$ and a residual noise signal, $d_L$ that corresponds to residual or actual noise that is present in the rear zone 58*b* of the vehicle 12. The residual microphone 52 generates an error signal $e_L$ that corresponds to the difference between the cancellation signals and the residual noise signal $d_L$. The second rear filter 20" also receives the reference signals, $x_K$ and generates filtered reference signals, x'. The multiplier circuit 18 takes the product of the filtered reference signal, x' and the error signal, $e_L$ and outputs the same to the first rear adaptive filter 14". The first rear adaptive filter 14" updates its coefficients to generate another driving signal, to drive the loudspeakers 54*b*, 54*c* to generate another cancellation field to cancel not only road and engine noise, but the actual noise that is present in the rear zone 58*b* of the vehicle 12.

The first rear adaptive filter 14" can be adapted separately to not only cancel road and engine noise but cancel other noise present in the rear zone 58 according to the following equation:

$$w_{M_{rear}K}(n+N) = w_{M_{rear}K}(n) + IFFT\{\mu(f)\sum_{l=1}^{L} S_{LM_{rear}K}(f)E_L(f)\} \quad \text{(Eq. 3)}$$

As noted above in relation to FIG. 3, it is recognized that the ANC controller 10" may receive inputs from all of the microphones 52*a*-52*d* in the vehicle 12 irrespective of whether the microphones 52*a*-52*d* are positioned in the front zone 58*a* or the rear zone 58*b* in order to update the filter matrix for the first rear adaptive filter 14" and to prevent waterbed effects from being present in the sound field.

Figure 7:
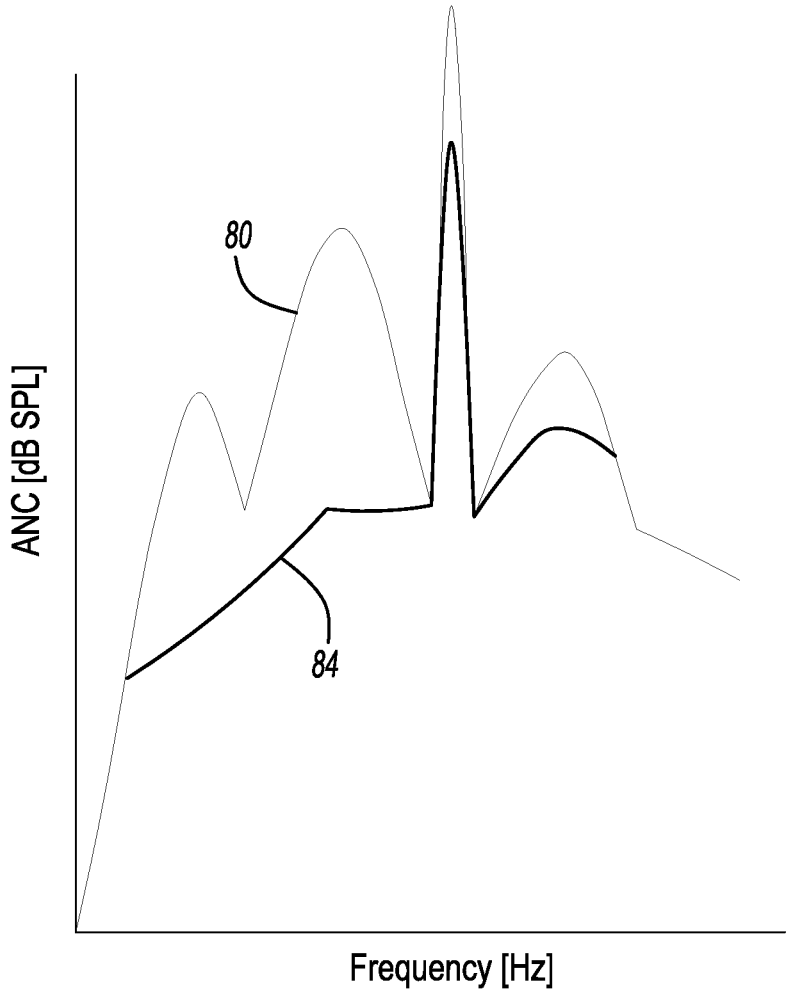
FIG. 7 depicts a plot corresponding to sound pressure level and frequency for the system of FIG. 5 in accordance to one embodiment.

FIG. 7 generally depicts training for the FxLMS algorithm for only the loudspeaker 54*b* (e.g. a rear loudspeaker) and 54*c* (e.g truck subwoofer) in the rear zone 58*b* with respect to the ANC performance. In general, waveform 80 corresponds to the sound pressure and frequency in the rear zone 58*b* when active noise cancellation is performed therein. Waveform 84 generally corresponds to the sound pressure and frequency in the rear zone 58*b* when active noise cancellation is disabled. In FIG. 7 depicts adequate levels of cancellation as most of the road resonances in this example are generated from a rear axle of the vehicle 12. This condition may also occur, if most of the noise was generated from the front in connection with FIG. 2. In this case, the front loudspeaker 54*a* may be contributing more to the cancellation.

It is recognized that the ANC controller 10 as set forth in FIG. 1 may generally include all of the hardware and software contained by the ANC controller 10' as set forth in FIG. 3 and by the ANC controller 10" as set forth in FIG. 6. Such controllers 10' and 10" are depicted to be separate to illustrate that one aspect of the ANC controller 10 selectively performs noise cancellation for the front zone 58*a* and that another aspect of the ANC controller 10 selectively performs noise cancellation for the rear zone 58*b*. In general, the ANC controller 10 may monitor the noise present in each of the front zone 58*a* and the rear zone 58*b* and perform the selective noise cancellation in the zone 58*a*, 58*n* based on which zone exhibits the highest amount of noise. For example, the ANC controller 10 measures the amount of noise that is present in the front zone 58*a* and the rear zone 58*b* via the microphones 52*a*-52*d*. If the amount of noise is greater than a predetermined noise level (e.g., approximately 3 dB (A)), then the ANC controller 10 selectively performs noise cancellation in the zone that exceeds the predetermined noise level. Assuming for example that the noise in both the front zone 58*a* and the rear zone 58*b* exceed the predetermined noise level, the ANC controller 10 may perform noise cancellation in the zone detected to have the highest amount of noise. Once the noise in such a zone decreases below the predetermined noise level, the ANC controller 10 performs noise cancellation in the other zone of the vehicle 12 that exhibits a noise level that exceeds the predetermined noise level.

It is recognized that the ANC controller 10' (i.e., that performs cancellation in the front zone 58*a*) and the ANC controller 10" (i.e., the performs cancellation in the rear zone 58*b*) that both comprise the ANC controller 10 must be trained prior to performing the noise cancellation. The first front adaptive filter 14' (or $w_{M_{front}K}$) can be trained first and the first rear adaptive filter 14" (or $w_{M_{rear}K}$) can be trained thereafter. For example, when the first front adaptive filter 14' grows, for example, from 0.000 to a maximum value of 0.01, then the first front adaptive filter 14' is considered to stop growing and has reached its optimum or maximum value. In this case, the first front adaptive filter 14' reaches approximately 3 dB(A) (e.g., a predetermined noise level). Once the first front adaptive filter 14' is trained (e.g., reaches a maximum of 0.01), then the first rear adaptive filter 14' is similarly trained and also reaches the predetermined noise level of, for example, 3 dB(A). The convergence speed of the algorithm employed for the first front adaptive filter 14' (and the first rear adaptive filter 14") is defined by the step-size 0.00001-0.01 for an FxLMS algorithm (e.g., the variable μIFFT as set forth in Eq. 1) with standard audio loudspeakers. The overall cancellation from 20-300 Hz must be at least 3 dB(A) as a criterion for optimal adaptation and audible noise cancellation performance. Thus, when the first front adaptive filter 14' reaches 3 dB(A), this generally indicates an overall reduction of the sound pressure in the front zone 14' and the training of the first front adaptive filter 14' is complete. Similar methodology applies for the first rear adaptive filter 14".

In one example, the training of each adaptive filter 14' or 14" may be performed by driving the vehicle 12 over a rough or cobblestone road for each adaptive filter 14' or 14" to be optimized from zero values. Such a training (or partitioning) of algorithms for the filters 14' or 14" may result in the adaptive filters 14' and 14" to a partitioned W-filter matrix as not all of the loudspeakers 54*a*, 54*b*, and 54*c* can be driven at once. Therefore, the cancellation signals may be calculated separately as exhibited with the following equation.

$$y_{M_{front}}(n)=w_{M_{front}K}(n)*x_K(n) \quad \text{(Eq. 4)}$$

$w_{M_{front}K}(n)$ corresponds to first front adaptive filters 14' that are trained by the various reference signals for the reference sensors (e.g., noise and vibration sensors such as accelerometers) positioned at a front axle of the vehicle 12.

Once the $w_{M_{front}K_{front}}$ reach their maximum values, then convolutions for the loudspeakers 52*c* and 52*d* can be activated as exhibited by the following equation.

$$y_{M_{rear}}(n)=w_{M_{rear}K}(n+N)*x_K(n) \quad \text{(Eq. 5)}$$

$w_{M_{rear}K_{rear}}$ corresponds to first rear adaptive filters 14" that are trained by the various reference signals for the reference sensors (e.g., accelerometers) positioned at a rear axle of the vehicle 12. As a result, the multiplication that the DSP of the ANC filter 10 needs to run for every cycle can be significantly reduced as exhibited by the following:

12×2×4 References×Secondary path matrix multiplication=96×Multiplications for the filtered reference signals.

Figure 8:
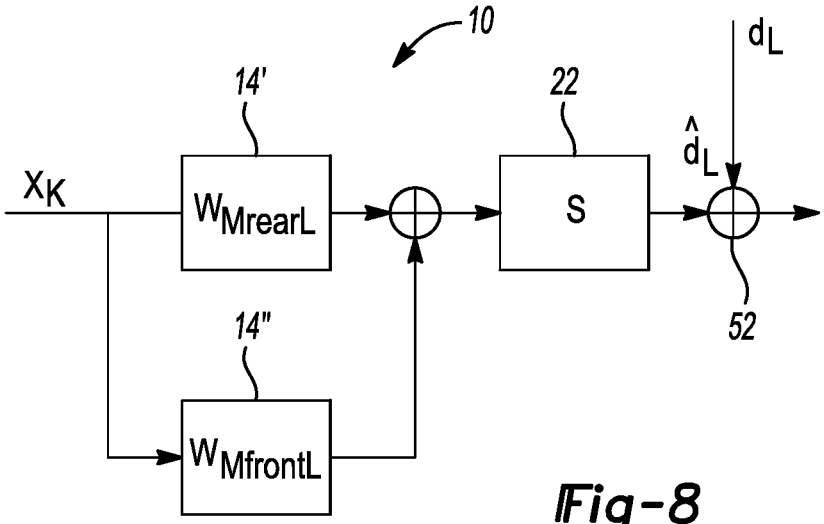
FIG. 8 depicts one example of an apparatus that performs selective noise cancellation once a training stage for a front and a rear loudspeaker system has been performed in accordance to one embodiment.
Figure 9:
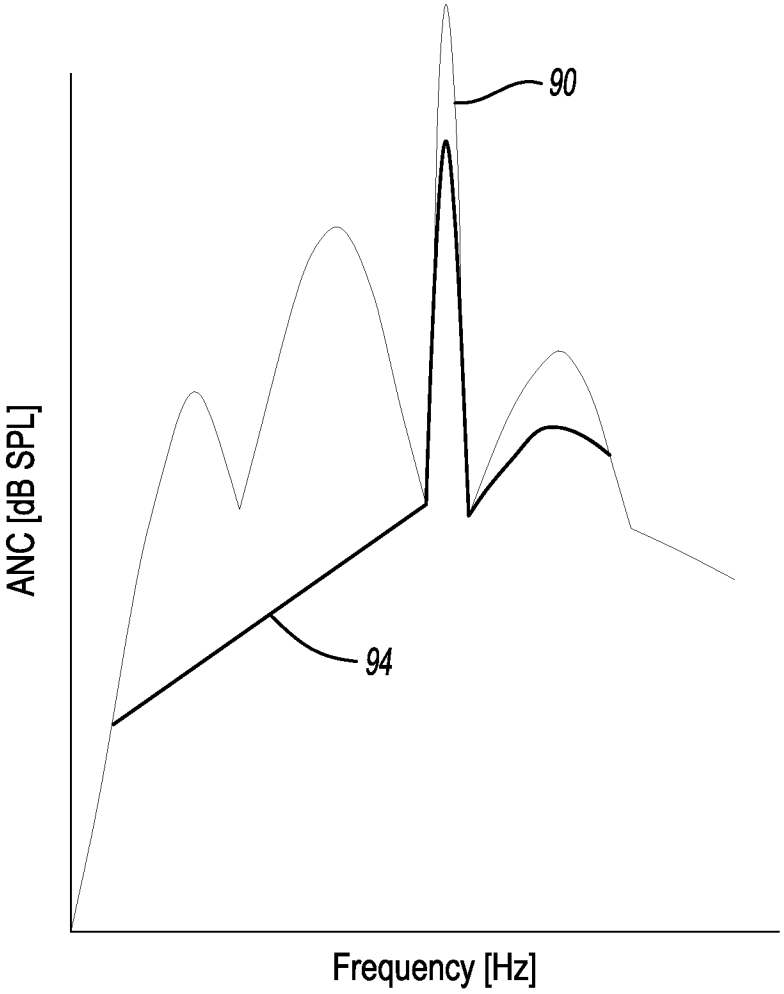
FIG. 9 depicts a plot corresponding to sound pressure level and frequency for apparatus of FIG. 8 in accordance to one embodiment.

Once the two training stages for front and rear loudspeaker systems are performed, then one only full W-filter matrix may be running in the DSP of the ANC filter 10 as exhibited in FIG. 8. FIG. 9 generally depicts the corresponding cancellation performance spectra for the full W-filter matrix (e.g., both the first front adaptive filter 14' and the first rear adaptive filter 14"). Waveform 90 corresponds to the sound pressure and frequency in the front zone 58*a* and the rear zone 58*b* when active noise cancellation is selectively performed between the front zone 58*a* and the rear zone 58*b*. Waveform 94 generally corresponds to the sound pressure and frequency in the front zone 58*a* and rear zone 58*b* when active noise cancellation is disabled.

Figure 10:
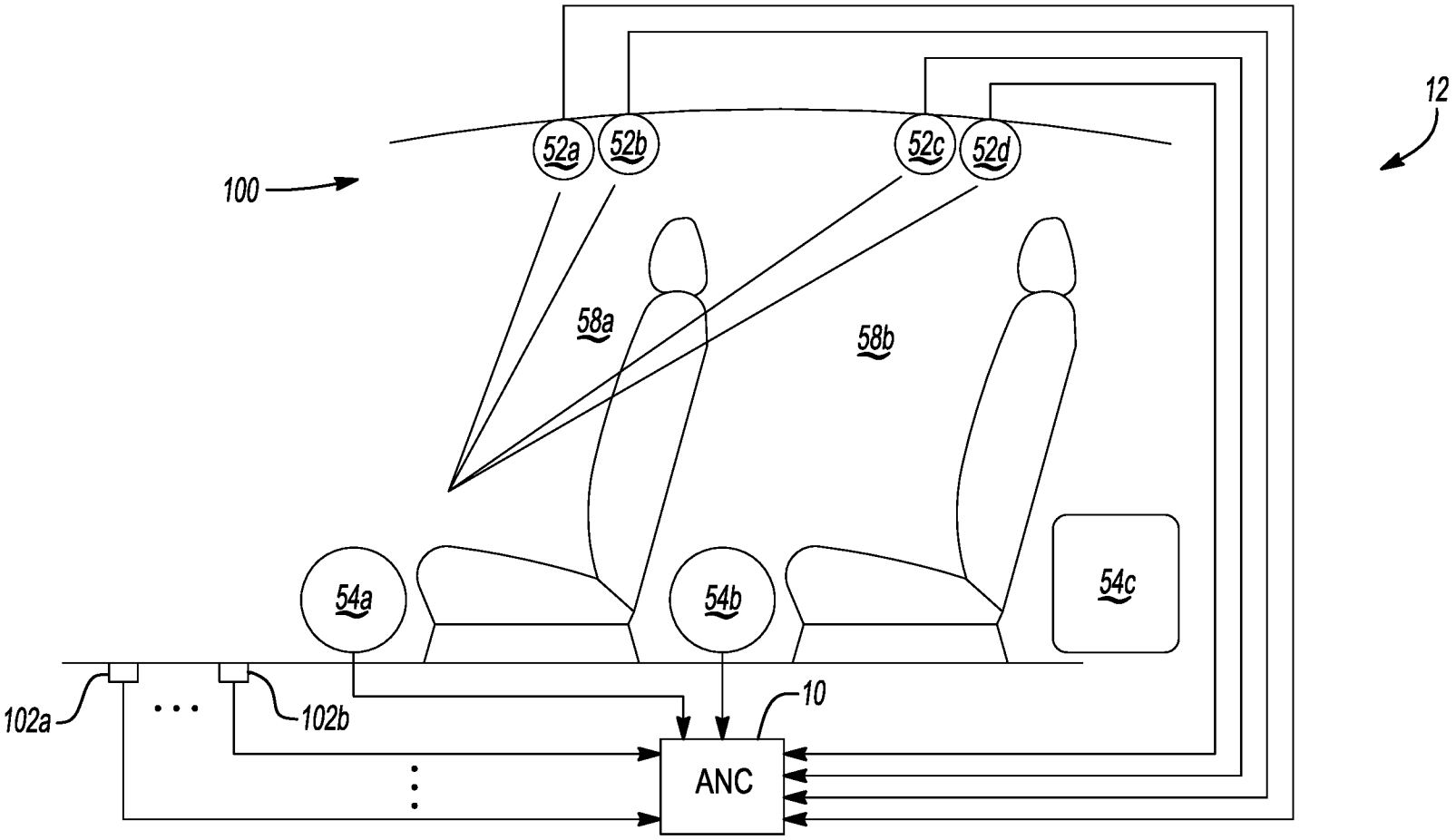
FIG. 10 depicts another system that performs selective noise cancellation utilizing front axle vibration signals in accordance to one embodiment.

FIG. 10 depicts a system 100 that performs selective noise cancellation utilizing front axle vibration signals in accordance to one embodiment. The system 100 is generally similar to the systems 50 and 50' as noted above in connection with FIGS. 2 and 5. However, the system 100 further includes front sensors (or front axle sensors) 102*a* and 102*b* (e.g., noise and vibration signals such as accelerometers) positioned on a front axle (not shown) of the vehicle 12 which provide additional signals indicative of road noise to the ANC controller 10. For example, the front axle sensors 102*a* and 102*b* provide signals indicative of vibration of the front axle that are indicative of road noise.

The system 100 provides an additional reduction in the dimensions of the filter matrix for the first adaptive filter 14 (i.e., the first front adaptive filter 14' and the first rear adaptive filter 14"). For example, the filter matrix can be performed according to the most coherent input signals and specific road noise frequency areas. If the front axle vibration signals have the high contribution, meaning the high coherence in the frequency range of interest, then the adaptation equations for the first front adaptive filter 14' and the first rear adaptive filter 14" can be further reduced as follows:

$$w_{M_{front}K_{front}}(n+N) = w_{M_{front}K_{front}}(n) + IFFT\left\{\mu(f)\sum_{l=1}^{L} S_{LM_{front}K_{front}}(f)E_L(f)\right\} \quad \text{(Eq. 6)}$$

$$w_{M_{rear}K_{front}}(n+N) = w_{M_{rear}K_{front}}(n) + IFFT\left\{\mu(f)\sum_{l=1}^{L} S_{LM_{rear}K_{front}}(f)E_L(f)\right\} \quad \text{(eq. 7)}$$

Such a modification in the update equation as shown in Equations 6 and 7 can result in an extra reduction in the computation of FFTs, as for example, half of the reference signals are calculated in the following manner:

6×FFTs for the reference signals+4×FFTs for the error signals=10×FFTs

After training the corresponding W-filters for front and rear axle sensors 102*c*, 102*d* and for the loudspeaker 54*a* in the front zone 58*a* and the loudspeakers 54*b*, 54*c* in the rear zone 58*b*, then the entire W-filter matrix for the first adaptive filter 14 can formed to reduce the road noise spectrum.

Figure 11:
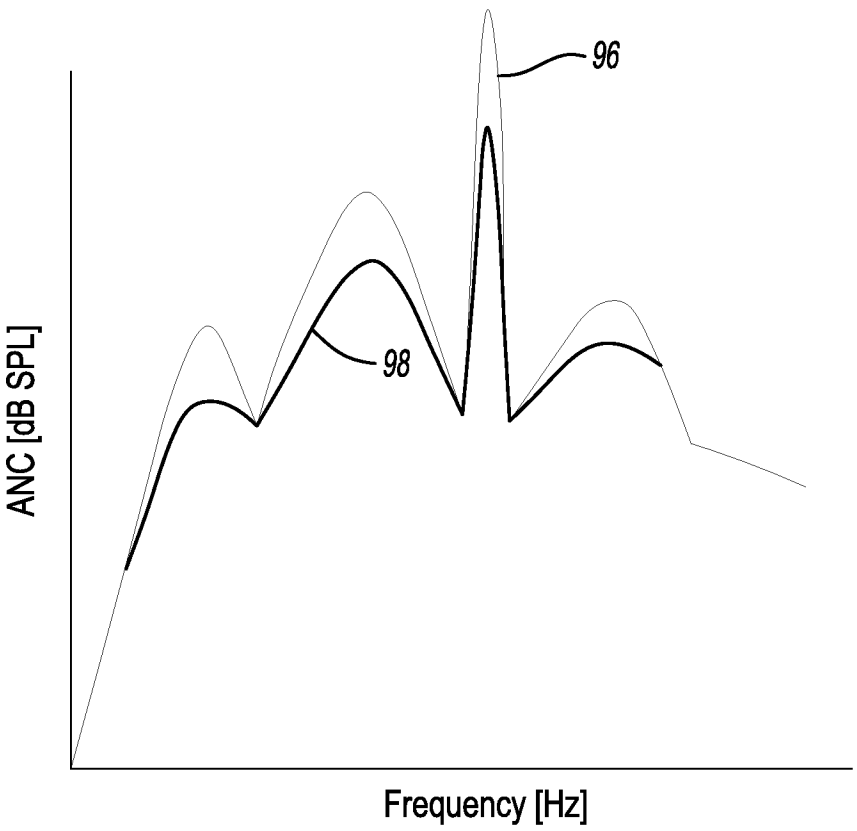
FIG. 11 depicts a plot corresponding to sound pressure level and frequency for the system of FIG. 10 in accordance to one embodiment.

FIG. 11 depicts a plot corresponding to sound pressure level and frequency for the system of FIG. 10 in accordance to one embodiment. Waveform 96 corresponds to the sound pressure and frequency in the front zone 58*a* and the rear zone 58*b* when active noise cancellation is selectively performed between the front zone 58*a* and the rear zone 58*b*. Waveform 98 generally corresponds to the sound pressure and frequency in the front zone 58*a* and rear zone 58*b* when active noise cancellation is disabled.

Figure 12:
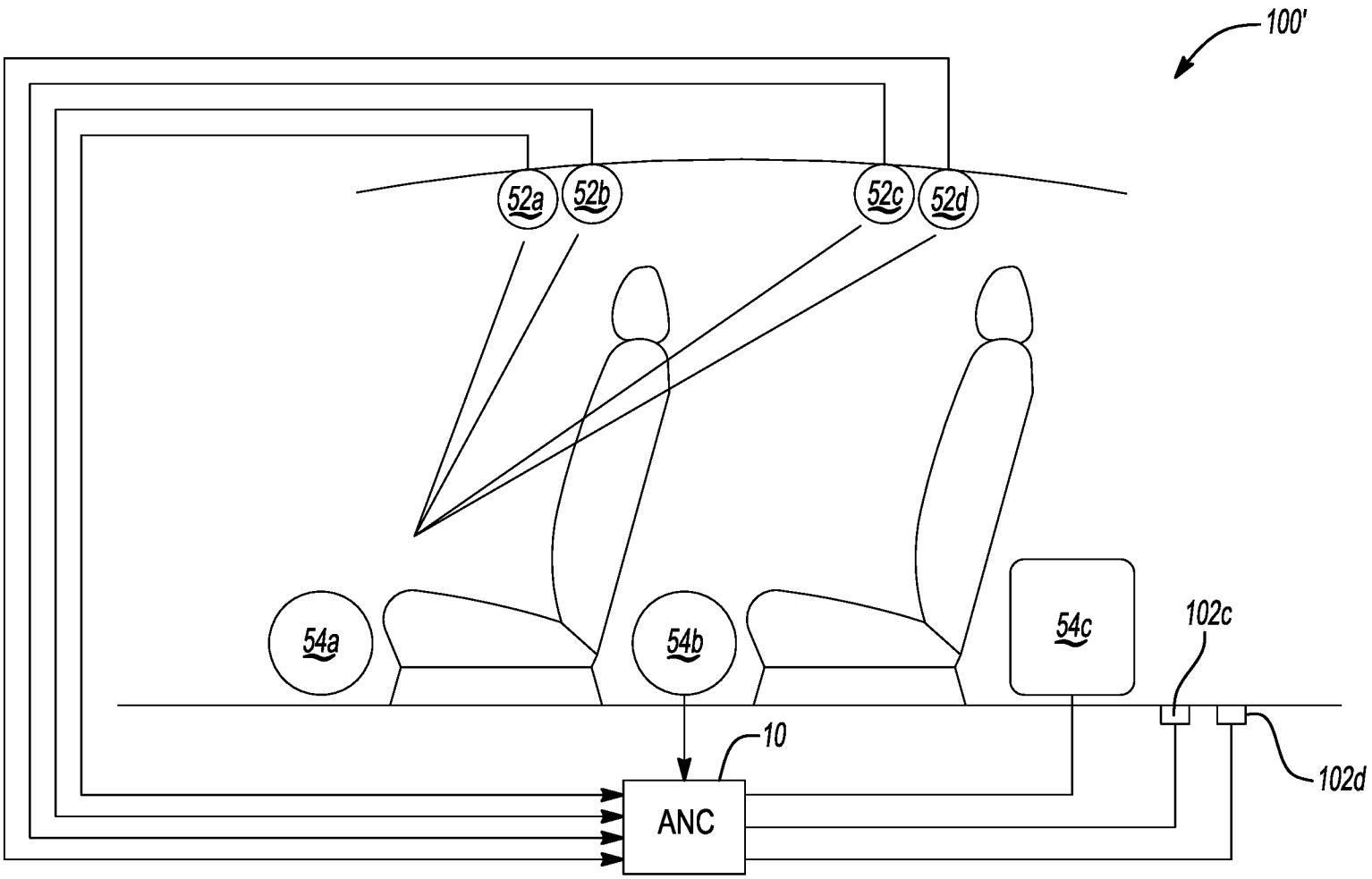
FIG. 12 depicts another system that performs selective noise cancellation utilizing rear axle vibration signals in accordance to one embodiment.

FIG. 12 depicts a system 100' including rear axle sensors (or rear sensors) 102*c* and 102*d* (e.g., noise and vibration sensors such as accelerometers) that are used in connection with training the corresponding W-filters (e.g., first adaptive filter 14) as noted above in connection with FIG. 10. The system 100' is generally similar to the system 100 as depicted in connection with FIG. 10 with the exception of the inclusion of the rear axle sensor 102*c* and 102*d*.

In general, while the systems 50 and 50' are trained utilizing front and rear loudspeakers 54*a*-54*c*, respectively, the systems 100 and 100' are trained utilizing reference signals from the front axle sensors 102*a*-102*b* and the rear axle sensors 102*c*-102*d*, respectively. In both cases, such training provides less computational expense for the ANC controller 10. For each training operation performed for the reference signals from the front axle sensors 102*a*-102*b* and the training operation performed for the reference signals from the rear axle sensors 102*c*-102*d*, the first adaptive filter 14 of the ANC controller 10 grows from 0.000 to a maximum value of 0.01 and this condition is considered to enable the first adaptive filter 14 to reach its optimum value. This is done separately for the reference signals received from the front axle sensors 102*a*-102*b* and for the reference signals received from the rear axle sensors 102*c*-102*d*.

In an additional embodiment, the ANC controller 10 may be trained by utilizing the reference signals from the front axle sensors 102*a*-102*b* while driving only the front loudspeaker 54*a* based on the various aspects disclosed herein. Alternatively, the ANC controller 10 may be trained by utilizing the reference signals from the rear axle sensors 102*c*-102*d* while driving only the rear loudspeakers 54*b*, 54*c* based on the various aspects disclosed herein.

It is recognized that the ANC controller 10' (i.e., that performs cancellation in the front zone 58*a*) and the ANC controller 10" (i.e., the performs cancellation in the rear zone 58*b*) that both comprise the ANC controller 10 must be trained prior to performing the noise cancellation. The first front adaptive filter 14' (or $w_{M_{front}K}$) can be trained first and the first rear adaptive filter 14" (or $w_{M_{rear}K}$) can be trained thereafter. When the first front adaptive filter 14' increases, for example, from 0.000 to a maximum value of 0.01, then the first front adaptive filter 14' is considered to stop growing and has reached its optimum or maximum value. In this case, the first front adaptive filter 14' reaches 3 dB(A). Once the first front adaptive filter 14' is trained (e.g., reaches a maximum of 0.01), then the first rear adaptive filter 14' is similarly trained. The convergence speed of the algorithm employed for the first front adaptive filter 14' (and the first rear adaptive filter 14") is defined by the step-size 0.00001-0.01 for an FxLMS algorithm (e.g., the variable μIFFT as set forth in Eq. 1) with standard audio loudspeakers. The overall cancellation from 20-300 Hz must be at least 3 dB(A) as a criterion for optimal adaptation and audible noise cancellation performance. Thus, when the first front adaptive filter 14' reaches 3 dB(A), this generally indicates an overall reduction of the sound pressure in the front zone 14' and the training of the first front adaptive filter 14' is complete. Similar methodology applies for the first rear adaptive filter 14". A similar methodology may be applied to the first rear adaptive filter 14".

Figure 13:
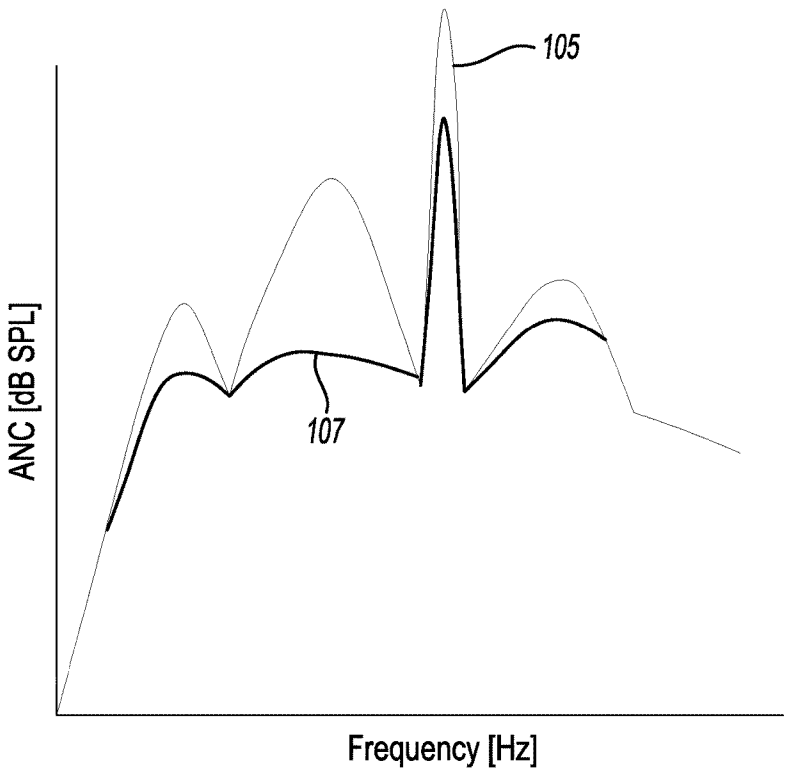
FIG. 13 depicts a plot corresponding to sound pressure level and frequency for the system of FIG. 12 in accordance to one embodiment.

FIG. 13 depicts a plot corresponding to sound pressure level and frequency for the system of FIG. 12 in accordance to one embodiment. Waveform 105 corresponds to the sound pressure and frequency in the front zone 58*a* and the rear zone 58*b* when active noise cancellation is selectively performed between the front zone 58*a* and the rear zone 58*b*. Waveform 107 generally corresponds to the sound pressure and frequency in the front zone 58*a* and rear zone 58*b* when active noise cancellation is disabled.

Figure 14:
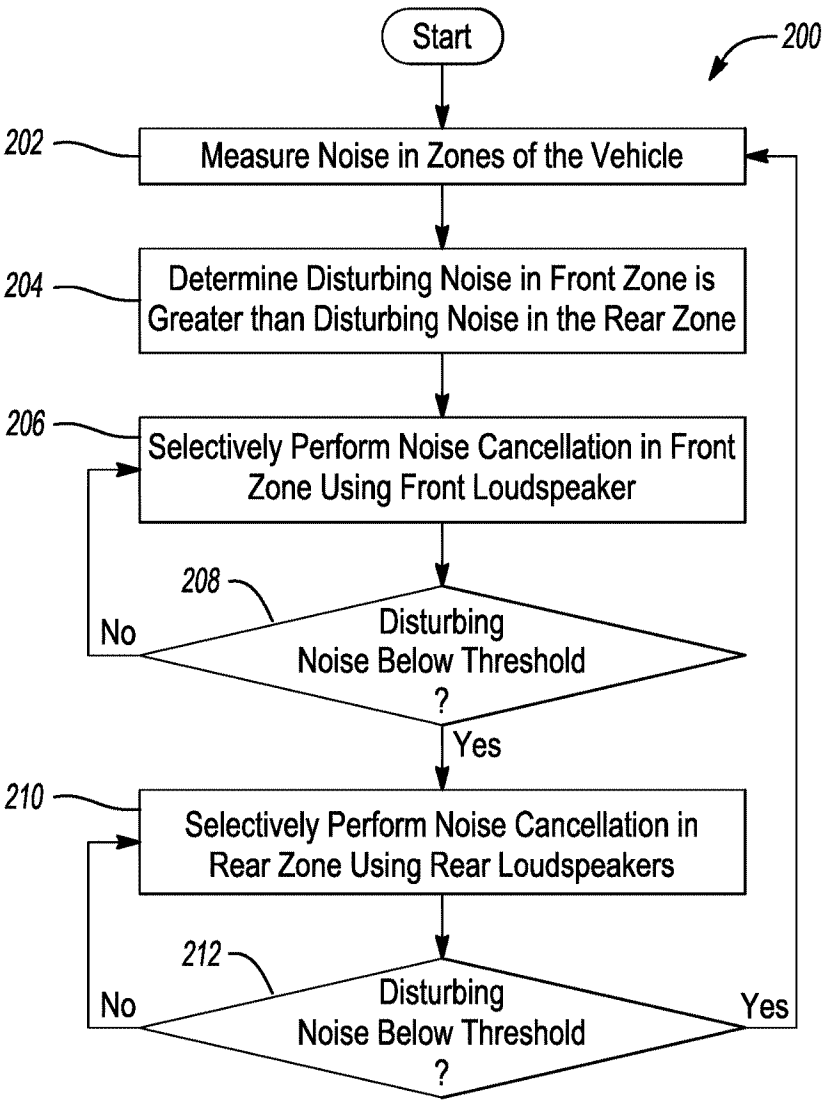
FIG. 14 depicts a method for performing selective noise cancellation in accordance to one embodiment.

FIG. 14 depicts a method 200 for performing selective noise cancellation in accordance to one embodiment.

In operation 202, the system 50, 50' (hereafter "50" for brevity) (or the ANC controller 10' or 10" (hereafter 10' for brevity) determines the amount of noise that is present in the front zone 58*a* and in the rear zone 58*b*.

In operation 204, the system 50 (or the ANC controller 10') determines that the noise present in the front zone 58*a* is greater than the noise present in the rear zone 58*b*.

In operation 206, the system 50 (or the ANC controller 10') performs selective noise cancellation in the front zone 58*a* by generating a cancellation signal with the front loudspeaker 54*a* to cancel any disturbing noise in the front zone 58*a*. In this case, the loudspeakers 54*b*, 54*c* are disabled with respect to generating a cancellation signal while the loudspeaker 54*a* generates the cancellation signal. With respect to the disabling of the loudspeakers 54*b*, 54*c*; the ANC controller 10' may simply not activate such loudspeakers 54*b*, 54*c* to provide the cancellation signals or refrain from providing any control thereof.

For example, the first front adaptive filter 14' adjusts its filter coefficients and generates a driving signal, y to drive the loudspeaker 54*a* in the front zone 58*a* to cancel the road noise, engine noise, or vibrational noise based on the information included in the reference signal $x_k$. The loudspeaker 54*a* generates a cancellation signal, $d'_L$ which propagates through the front secondary path 22'. The residual microphone 52 receives the cancellation signal, $d'_L$ and a residual noise signal, $d_L$ that corresponds to residual or actual noise that is present in the front zone 58*a* of the vehicle 12. The residual microphone 52 generates an error signal $e_L$ that corresponds to the difference between the cancellation signal and the residual noise signal $d_L$. The second front filter 20' also receives the reference signals, $x_K$ and generates filtered reference signals, x'. The multiplier circuit 18 takes the product of the filtered reference signals, x' and the error signal and outputs the same to the first front adaptive filter 14. The first front adaptive filter 14' updates its coefficients to generate another driving signal, to drive the loudspeaker 54*a* in order to generate another cancellation field to cancel not only road and/or engine noise, but the actual noise that is present in the front zone 58*a* of the vehicle 12. As noted above, the ANC controller 10' continues to utilize all microphones 52*a*-52*d* that is present on the vehicle 12 to perform this operation.

In operation 208, the system 50 (or the ANC controller 10') and monitors the noise that is present in the front zone 58*a* after generating the cancellation field via the loudspeaker 54*a* in the front zone to cancel the disturbing noise that is present in the front zone 58*a*. If the noise in the front zone 58*a* falls below predetermined noise level, then the method 200 moves to operation 210. If not, then the method 200 moves to operation 206 to continue to reduce the disturbing noise that is present in the front zone 58*a*.

In operation 210, the system 50' (or the ANC controller 10') performs selective noise cancellation in the rear zone 58*b* by generating a cancellation signal with the rear loudspeakers 54*b*, 54*c* to cancel any disturbing noise in the rear zone 58*b*. This operation is generally similar to operation 206 with the exception being that only the rear loudspeakers 54*b*, 54*c* generate the cancellation field in the rear zone 58*b* while the ANC controller 10' continues to utilize signals from all of the microphones 52-52*d*. In this case, the loudspeaker 54*a* is disabled with respect to generating a cancellation signal while the loudspeakers 54*b* and 54*c* each generate the cancellation signal. With respect to the disabling of the loudspeakers 54*a*, the ANC controller 10' may simply not activate the loudspeaker 54*a* to provide the cancellation signals or refrain from providing any control thereof.

In operation 212, the system 10' (or the ANC controller 10') monitors the noise that is present in the rear zone 58*b* after generating the cancellation field via the rear loudspeakers 54*b*, 54*c* to cancel the disturbing noise that is present in the rear zone 58*b*. If the noise in the rear zone 58*b* falls below the predetermined noise level, then the method 200 moves to operation 202. If not, then the method 200 moves to operation 210 to continue to reduce the disturbing noise that is present in the rear zone 58*b*.

Figure 15:
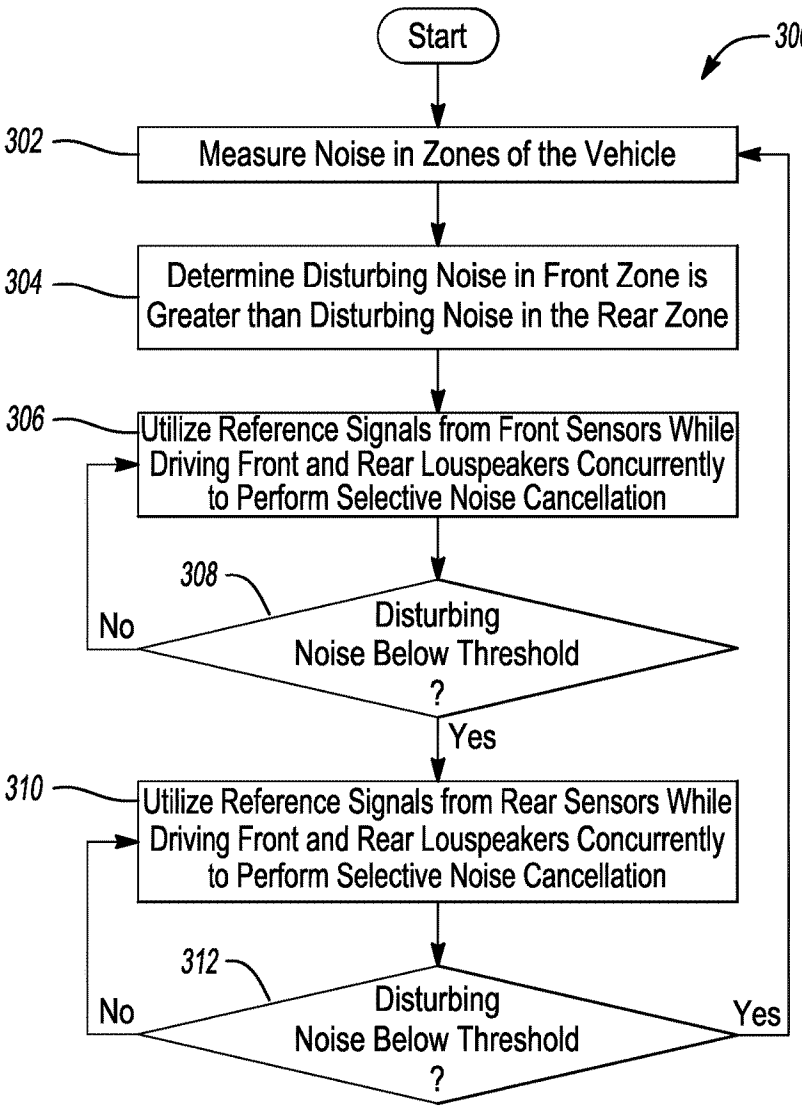
FIG. 15 depicts a method for performing selective noise cancellation in accordance to one embodiment.

FIG. 15 depicts a method 300 for performing selective noise cancellation in accordance to one embodiment.

In operation 302, the system 100, 100' (hereafter "100" for brevity) (or the ANC controller 10' or 10" (hereafter 10' for brevity) determines the amount of noise that is present in the front zone 58*a* and in the rear zone 58*b*.

In operation 304, the system 100' (or the ANC controller 10') determines that the noise present in the front zone 58*a* is greater than the noise present in the rear zone 58*b*.

In operation 306, the system 100' (or the ANC controller 10') performs selective noise cancellation in the front zone 58*a* and the rear zone 58*b* by concurrently generating a cancellation signal with the front loudspeaker 54*a* and the rear loudspeakers 54*b*, 54*c*, respectively, to cancel any disturbing noise in the front zone 58*a* and the rear zone 58*b*. In this operation, the ANC controller 10' utilizes reference signals only from the front sensors 102*a* and 102*b*. This condition minimizes computational expense for the ANC controller 10'. This operation may be performed similarly to operation 206 as set forth in FIG. 14 with the exception being that each of the front and the rear loudspeakers 54*a*, 54*b*, 54*c* provides a cancellation field for the front and the rear zone 58*a*, 58*b*, respectively while only utilizing the reference signals only from the front sensors 102*a*, 102*b* and while utilizing all microphone outputs from the microphones 52*a*-52*d* (e.g., all error microphones in the vehicle 12).

In operation 308, the system 100' (or the ANC controller 10') monitors the noise that is present in the front zone 58*a* after generating the cancellation field via the loudspeakers 54*a*, 54*b*, and 54*c* for the front zone 58*a* and the rear zone 58*b*. If the noise in the front zone 58*a* falls below the predetermined noise level, then the method 300 moves to operation 310. If not, then the method 300 moves to back operation 306.

In operation 310, the system 100' (or the ANC controller 10') performs selective noise cancellation in the front zone 58*a* and the rear zone 58*b* by concurrently generating a cancellation signal with the front loudspeaker 54*a* and the rear loudspeakers 54*b*, 54*c*, respectively, to cancel any disturbing noise in the front zone 58*a* and the rear zone 58*b*. In this operation, the ANC controller 10' utilizes reference signals only from the rear sensors 102*c* and 102*d* while utilizing all outputs from the microphones 52*a*-52*d*. This condition minimizes computational expense for the ANC controller 10'. This operation may be performed similarly to operation 206 as set forth in FIG. 14 with the exception being that each of the front and the rear loudspeakers 54*a*, 54*b*, 54*c* provides a cancellation field for the front and the rear zone 58*a*, 58*b*, respectively, while only utilizing the reference signals only from the rear sensors 102*c*, 102*d* and while utilizing all microphone outputs from the microphones 52*a*-52*d* (e.g., all error microphones in the vehicle 12).

In operation 312, the system 100' (or the ANC controller 10') monitors the noise that is present in the rear zone 58*b* after generating the cancellation field via the loudspeakers 54*a*, 54*b*, and 54*c* for the front zone 58*a* and the rear zone 58*b* (and while utilizing the reference signals from only the rear sensors 102*c* and 102*d*). If the noise in the rear zone 58*a* falls below the predetermined noise level, then the method 300 moves to operation 302. If not, then the method 300 moves to back operation 310.

Figure 16:
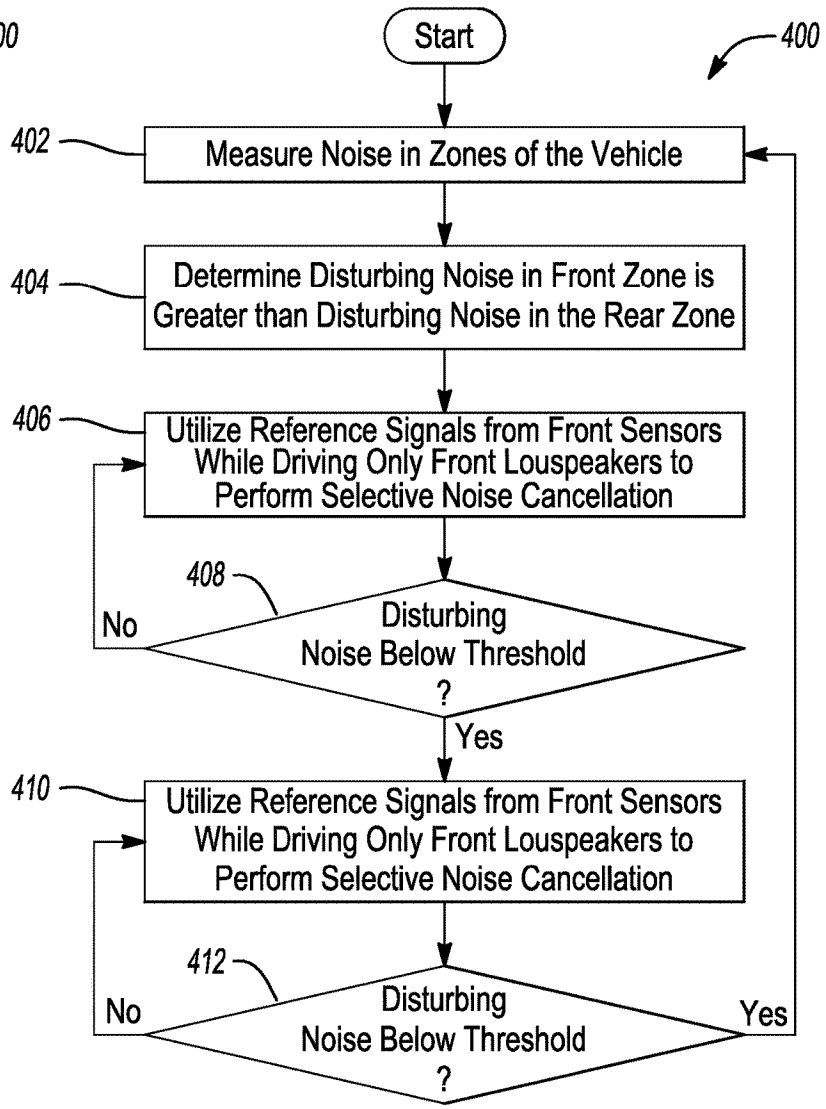
FIG. 16 depicts a method for performing selective noise cancellation in accordance to one embodiment.

FIG. 16 depicts a method 400 for performing selective noise cancellation in accordance to one embodiment.

In operation 402, the system 100, 100' (hereafter "100" for brevity) (or the ANC controller 10' or 10" (hereafter 10' for brevity) determines the amount of noise that is present in the front zone 58*a* and in the rear zone 58*b*.

In operation 404, the system 100' (or the ANC controller 10') determines that the noise present in the front zone 58*a* is greater than the noise present in the rear zone 58*b*.

In operation 406, the system 100' (or the ANC controller 10') performs selective noise cancellation in the front zone 58*a* with only the front loudspeaker 54*a* to cancel any disturbing noise in the front zone 58*a*. In this operation, the ANC controller 10' utilizes reference signals only from the front sensors 102*a* and 102*b*. This condition minimizes computational expense for the ANC controller 10'. This operation may be performed similarly to operation 206 as set forth in FIG. 14 with the exception being that the front loudspeaker 54*a* provides a cancellation field for the front zone 58*a* respectively, while only utilizing the reference signals only from the front sensors 102*a*, 102*b* and while utilizing all microphone outputs from the microphones 52*a*-52*d* (e.g., all error microphones in the vehicle 12). In this case, the loudspeakers 54*b*, 54*c* are disabled with respect to generating a cancellation signal while the loudspeaker 54*a* generates the cancellation signal. With respect to the disabling of the loudspeakers 54*b*, 54*c*; the ANC controller 10' may simply not activate such loudspeakers 54*b*, 54*c* to provide the cancellation signals or refrain from providing any control thereof.

In operation 408, the system 100' (or the ANC controller 10') monitors the noise that is present in the front zone 58*a* after generating the cancellation field via the front loudspeaker 54*a*, for the front zone 58*a*. If the noise in the front zone 58*a* falls below the predetermined noise level, then the method 400 moves to operation 410. If not, then the method 400 moves to back operation 406.

In operation 410, the system 100' (or the ANC controller 10') performs selective noise cancellation in the rear zone 58*b* by generating a cancellation signal with the rear loudspeakers 54*b*, 58*c* to cancel any disturbing noise in the rear zone 58*b*. In this operation, the ANC controller 10' utilizes reference signals only from the rear sensors 102*c* and 102*d* while utilizing all outputs from the microphones 52*a*-52*d*. This condition minimizes computational expense for the ANC controller 10'. This operation may be performed similarly to operation 206 as set forth in FIG. 14 with the exception being that the rear loudspeakers 54*b*, 54*c* provide each provide a cancellation field for the rear zone 58*b* while only utilizing the reference signals only from the rear sensors 102*a*, 102*b* and while utilizing all microphone outputs from the microphones 52*a*-52*d* (e.g., all error microphones in the vehicle 12). In this case, the loudspeaker 54*a* is disabled with respect to generating a cancellation signal while the loudspeakers 54*b* and 54*c* each generate the cancellation signal. With respect to the disabling of the loudspeakers 54*a*, the ANC controller 10' may simply not activate the loudspeaker 54*a* to provide the cancellation signals or refrain from providing any control thereof.

In operation 412, the system 100' (or the ANC controller 10') monitors the noise that is present in the rear zone 58*b* after generating the cancellation field via the loudspeakers 54*b*, 54*c* for the rear zone 58*b* (and while utilizing the reference signals from only the rear sensors 102*c* and 102*d*). If the noise in the rear zone 58*b* falls below the predetermined noise level, then the method 400 moves to operation 402. If not, then the method 400 moves back to operation 410.

In general, the embodiments set forth herein may perform, but not limited to, the following:

1) Selective noise cancellation utilizing all reference signals and all microphones signals in the vehicle 12 while only driving the front loudspeaker 54*a* to cancel undesired noise in the front zone 58*a*.

2) Selective noise cancellation utilizing all reference signals and all microphones signals in the vehicle 12 while selectively driving rear loudspeakers 54*b*, 54*c* to cancel undesired noise in the rear zone 58*b*.

3) Selective noise cancellation by utilizing reference signals from only front vehicle sensors (or front axles sensors 102*a*-102*b*) and all microphones signals while driving front loudspeakers 54*a* and rear loudspeakers 54*b*, 54*c* concurrently to cancel undesired noise in the front zone 58 and the rear zone 58*b*.

4) Selective noise cancellation by utilizing reference signals from only rear vehicle sensors (or rear axles sensors 102*c*-102*d*) and while driving front loudspeakers 54*a* and rear loudspeakers 54*b*, 54*c* concurrently to cancel undesired noise in the front zone 58 and the rear zone 58*b*.

5) Selective noise cancellation utilizing reference signals only from front sensors 102*a*-102*b* and all microphone signals in the vehicle 12 while only driving front loudspeakers 54*a* to cancel undesired noise in the front zone 58*a*.

6) Selective noise cancellation utilizing reference signals only from rear sensors 102*c*-102*d* and all microphone signals in the vehicle 12 while only driving rear loudspeakers 54*b*, 54*c* to cancel undesired noise in the rear zone 58*b*.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system for performing selective active noise cancellation (ANC) for a vehicle, the system comprising:

a plurality of reference sensors for being positioned external to a vehicle cabin and being configured to generate reference signals indicative of at least one of road noise and engine noise that is external to the vehicle cabin;

at least one first loudspeaker for being positioned in a first zone of the vehicle and being configured to generate a first cancellation field to cancel the at least one of road noise and engine noise in the first zone;

at least one second loudspeaker for being positioned in a second zone of the vehicle and being configured to generate a second cancellation field to cancel the at least one of road noise and engine noise in the second zone;

a plurality of error microphones for being positioned in the first zone and the second zone of the vehicle and being configured to generate a plurality of error signals; and at least one ANC controller configured to:

determine an amount of noise present in the first zone and the second zone;

selectively drive only the at least one first loudspeaker in the first zone to generate the first cancellation field in response to the amount of noise present in the first zone being greater than the amount of noise present in the second zone of the vehicle; and selectively drive only the at least one second loudspeaker in the second zone to generate the second cancellation field based in response to the amount of noise present in the second zone being greater than the amount of noise present in the first zone, wherein the at least one ANC controller includes a first adaptive filter that is trained to reach a first predetermined noise level while driving only the at least one first loudspeaker and while the at least one second loudspeaker is disabled.

2. The system of claim 1, wherein the at least one ANC controller is further configured to drive only the at least one first loudspeaker to generate the first cancellation field in the first zone and to disable driving the at least one second loudspeaker from generating the second cancellation field in the second zone while driving the at least one first loudspeaker in response to the amount of noise present in the first zone being greater than the amount of noise present in the second zone of the vehicle.

3. The system of claim 2, wherein the at least one ANC controller is further configured to drive only the at least one first loudspeaker to generate the first cancellation field in the first zone and to disable driving the at least one second loudspeaker from generating the second cancellation filed in the second zone while receiving all of the error signals from the error microphones positioned in the first zone and in the second zone of the vehicle.

4. The system of claim 3, wherein the at least one ANC controller is further configured to prevent waterbed effects from being present in the first zone and the second zone while driving only the at least one first loudspeaker to generate the first cancellation field in the first zone and while receiving all of the error signals from the error microphones.

5. The system of claim 1, wherein the at least one ANC controller is further configured to drive only the at least one second loudspeaker to generate the second cancellation field in the second zone and to disable driving the at least one first loudspeaker from generating the first cancellation field in the first zone while driving the at least one second loudspeaker in response to the amount of noise present in the second zone being greater than the amount of noise present in the first zone of the vehicle.

6. The system of claim 5, wherein the at least one ANC controller is further configured to drive only the at least one second loudspeaker to generate the second cancellation field in the second zone and to disable driving the at least one first loudspeaker from generating the first cancellation field in the first zone while receiving all of the error signals from the error microphones positioned in the first zone and in the second zone of the vehicle.

7. The system of claim 6, wherein the at least one ANC controller is further configured to prevent waterbed effects from being present in the first zone and the second zone while driving only the at least one second loudspeaker to generate the second cancellation field in the second zone and while receiving all of the error signals from the error microphones.

8. The system of claim 1, wherein the at least one ANC controller includes a second adaptive filter that is trained to reach a second predetermined noise level while driving only the at least one second loudspeaker and while the at least one first loudspeaker is disabled.

9. The system of claim 8, wherein the first adaptive filter is trained prior to the second adaptive filter.

10. A method for performing selective active noise cancellation (ANC) for a vehicle, the method comprising:

generating reference signals via a plurality of reference sensors positioned external to a vehicle cabin, the reference signals being indicative of at least one of road noise and engine noise that is external to the vehicle cabin;

generating a first cancellation field via at least one first loudspeaker that is positioned in a first zone of the vehicle, the first cancellation field cancelling the at least one of road noise and engine noise in the first zone;

generating a second cancellation field via at least one second loudspeaker that is positioned in a second zone of the vehicle, the second cancellation field cancelling the at least one of road noise and engine noise in the second zone;

generating a plurality of error signals via a plurality of error microphones that is positioned in the first zone and the second zone of the vehicle;

determining an amount of noise present in the first zone and the second zone;

selectively driving only the at least one first loudspeaker in the first zone to generate the first cancellation field in response to the amount of noise present in the first zone being greater than the amount of noise present in the second zone of the vehicle;

selectively driving only the least one second loudspeaker in the second zone to generate the second cancellation field in response to the amount of noise present in the second zone being greater than the amount of noise present in the first zone of the vehicle; and training a first adaptive filter to reach a first predetermined noise level while driving only the at least one first loudspeaker to provide the first cancellation field and while disabling the at least one second loudspeaker from generating the second cancellation field.

11. The method of claim 10 further comprising driving only the at least one first loudspeaker in the first zone and disabling the at least one second loudspeaker in the second zone to provide the second cancellation field while driving the at least one first loudspeaker in response to the amount of noise present in the first zone being greater than the amount of noise present in the second zone of the vehicle.

12. The method of claim 11 further comprising driving only the at least one first loudspeaker in the first zone and disabling the at least one second loudspeaker in the second zone to provide the second cancellation field while receiving all of the error signals from the error microphones positioned in the first zone and in the second zone of the vehicle.

13. The method of claim 12 further comprising preventing waterbed effects from being present in the first zone and the second zone while driving only the at least one first loudspeaker to provide the first cancellation field in the first zone and while receiving all of the error signals from the error microphones.

14. The method of claim 10 further comprising driving only the at least one second loudspeaker in the second zone to generate the second cancellation field and disabling the at least one first loudspeaker from generating the first cancellation filed while driving the at least one second loudspeaker in response to the amount of noise present in the second zone being greater than the amount of noise present in the first zone of the vehicle.

15. The method of claim 14 further comprising driving only the at least one second loudspeaker in the second zone to generate the second cancellation field and disabling the at least one first loudspeaker from generating the first cancellation field in the first zone while receiving all of the error signals from the error microphones positioned in the first zone and in the second zone of the vehicle.

16. The method of claim 15 further comprising preventing waterbed effects from being present in the first zone and the second zone while driving only the at least one second loudspeaker to provide the second cancellation field in the second zone and while receiving all of the error signals from the error microphones.

17. The method of claim 10 further comprising training a second adaptive filter to reach a second predetermined noise level while driving only the at least one second loudspeaker to provide the second cancellation field and while disabling the at least one first loudspeaker from generating the first cancellation field.

18. A computer-program product embodied in a non-transitory computer readable medium that is programmed to perform selective active noise cancellation (ANC) for a vehicle, the computer-program product comprising instructions to:

determine an amount of noise present in a first zone and a second zone of the vehicle; and selectively drive only at least one first loudspeaker in the first zone to generate a first cancellation field to cancel at least one of road noise and engine noise in the first zone if the amount of noise in the first zone is greater than the amount of noise in the second zone;

selectively drive only at least one second loudspeaker in the second zone to generate the second cancellation field to cancel the at least one of road noise and engine noise in the second zone if the amount of noise in the second zone is greater than the amount of noise in the first zone; and train a first adaptive filter to reach a first predetermined noise level while driving only the at least one first loudspeaker to provide the first cancellation field and while disabling the at least one second loudspeaker from generating the second cancellation field.

* * * * *